US008235749B2

(12) United States Patent
Weldon et al.

(10) Patent No.: US 8,235,749 B2
(45) Date of Patent: Aug. 7, 2012

(54) ELECTRICAL CONNECTOR FOR PHOTOVOLTAIC MODULES

(75) Inventors: Steven Michael Weldon, Harrisburg, PA (US); Kyle D Thompson, Lancaster, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 255 days.

(21) Appl. No.: 12/787,094

(22) Filed: May 25, 2010

(65) Prior Publication Data

US 2011/0290303 A1 Dec. 1, 2011

(51) Int. Cl.
*H01R 13/73* (2006.01)

(52) U.S. Cl. ..... 439/565; 439/700

(58) Field of Classification Search ..... 439/565, 439/550, 557, 552, 562–563, 248, 252, 700
See application file for complete search history.

(56) References Cited

U.S. PATENT DOCUMENTS

| | | | | |
|---|---|---|---|---|
| 4,227,765 | A * | 10/1980 | Neumann et al. | 439/248 |
| 4,358,174 | A | 11/1982 | Dreyer | |
| 5,944,548 | A | 8/1999 | Saito | |
| 6,196,856 | B1 | 3/2001 | De Villeroche | |
| 6,776,668 | B1 * | 8/2004 | Scyoc et al. | 439/700 |
| 7,544,093 | B2 * | 6/2009 | Soubh et al. | 439/581 |
| 7,607,929 | B1 * | 10/2009 | Nguyen et al. | 439/246 |
| 7,625,247 | B1 * | 12/2009 | Mahoney et al. | 439/700 |
| 8,007,309 | B2 * | 8/2011 | Fan | 439/376 |
| 2011/0061705 | A1 * | 3/2011 | Croft et al. | 136/244 |
| 2011/0290303 | A1 * | 12/2011 | Weldon et al. | 136/251 |

FOREIGN PATENT DOCUMENTS

GB 856 171 12/1960

OTHER PUBLICATIONS

International Search Report, International Application No. PCT/US2011/000923, International Filing Date May 24, 2011.

* cited by examiner

*Primary Examiner* — Tulsidas C Patel
*Assistant Examiner* — Phuongchi Nguyen

(57) ABSTRACT

An electrical connector is provided for electrically connecting a junction box of a photovoltaic (PV) module to an electrical cable of a power distribution system. The electrical connector includes a housing extending along a central longitudinal axis from a cable segment to a mating segment. The housing has an intermediate segment that extends between the cable and mating segments. The intermediate segment includes a flange. The housing is configured to be mounted to a frame for the PV module. An electrical contact is held by the housing and is configured to establish an electrical connection between the junction box and the electrical cable. A biasing mechanism extends over the intermediate segment of the housing. The biasing mechanism extends from a flange end to a frame end. The flange end is engaged with the flange of the housing. The frame end is configured to engage the frame such that, when the housing is mounted to the frame, the biasing mechanism extends between and exerts a biasing force on the flange and the frame. The housing is movable relative to the frame and along the central longitudinal axis with and against the biasing force of the biasing mechanism.

20 Claims, 5 Drawing Sheets

ELECTRICAL CONNECTOR FOR PHOTOVOLTAIC MODULES

BACKGROUND OF THE INVENTION

The subject matter described and/or illustrated herein relates generally to photovoltaic (PV) modules, and more particularly, to an electrical connector for interconnecting a PV module with a power distribution system.

To produce electricity from solar energy, PV modules include a plurality of PV cells interconnected in series and/or parallel, according to the desired voltage and current parameters. PV cells are essentially large-area semiconductor diodes. Due to the photovoltaic effect, the energy of photons is converted into electrical power within a PV cell when the PV cell is irradiated by a light source, such as sunlight. A plurality of PV modules that are mechanically and electrically connected together is sometimes referred to as a PV panel.

Junction boxes are typically used to electrically connect PV modules to an electrical power distribution system for distributing the electricity generated by the PV modules. Junction boxes may also be used to connect PV modules together, for example in series and/or parallel, to create a PV panel or an array of PV panels. Each junction box is mounted on the corresponding PV module and is electrically connected to the power distribution system and/or another PV module via one or more electrical cables. The electrical cables are terminated by electrical connectors that mate with the junction box to electrically connect the cables thereto.

PV modules are mounted within the interior of a rigid frame that supports the PV module. The electrical connectors that terminate the electrical cables are rigidly held by the frame. Mating ends of the connectors extend within the interior of the frame, and terminating ends of the connectors extend outside the interior of the frame. The terminating ends of the electrical connectors terminate the electrical cables outside the interior of the frame, while the mating ends mate with the junction box within the interior of the frame. However, because the electrical connectors are rigidly held by the frame, the location and orientation of the electrical connectors cannot be manipulated relative to the frame. It may therefore be difficult to align the mating ends of the electrical connectors with the junction box during installation of the PV module within the frame. The relatively tight fit of the PV module within the interior of the frame may make it difficult to both mate the junction box with the electrical connectors and fit the PV module within the interior of the frame. For example, projection of the mating ends of the electrical connectors into the frame interior may interfere with insertion of the PV module therein. Moreover, and for example, it may be difficult to see the location and orientation of the junction box relative to the mating ends of the electrical connectors during insertion of the PV module into the frame interior.

BRIEF DESCRIPTION OF THE INVENTION

In one embodiment, an electrical connector is provided for electrically connecting a junction box of a photovoltaic (PV) module to an electrical cable of a power distribution system. The electrical connector includes a housing extending along a central longitudinal axis from a cable segment to a mating segment. The housing has an intermediate segment that extends between the cable and mating segments. The intermediate segment includes a flange. The housing is configured to be mounted to a frame for the PV module. An electrical contact is held by the housing and is configured to establish an electrical connection between the junction box and the electrical cable. A biasing mechanism extends over the intermediate segment of the housing. The biasing mechanism extends from a flange end to a frame end. The flange end is engaged with the flange of the housing. The frame end is configured to engage the frame such that, when the housing is mounted to the frame, the biasing mechanism extends between and exerts a biasing force on the flange and the frame. The housing is movable relative to the frame and along the central longitudinal axis with and against the biasing force of the biasing mechanism.

In another embodiment, an electrical connector assembly is provided for electrically connecting a junction box of a photovoltaic (PV) module to an electrical cable of a power distribution system. The electrical connector assembly includes a frame having a receptacle configured to receive the PV module therein, and an electrical connector. The electrical connector includes a housing extending a length along a central longitudinal axis from a cable segment to a mating segment. The housing has an intermediate segment that extends between the cable and mating segments. The intermediate segment includes a flange. The housing is mounted to the frame. An electrical contact is held by the housing and is configured to establish an electrical connection between the junction box and the electrical cable. A biasing mechanism extends over the intermediate segment of the housing. The biasing mechanism is engaged between the frame and the flange of the housing such that the biasing mechanism exerts a biasing force on the flange and the frame. The electrical connector is movable relative to the frame and along the central longitudinal axis with and against the biasing force of the biasing mechanism.

In another embodiment, a photovoltaic (PV) module assembly is provided. The PV module assembly includes a frame having a receptacle, a PV module held within the receptacle of the frame, a junction box mounted on and electrically connected to the PV module, and an electrical connector. The electrical connector includes a housing extending a length along a central longitudinal axis from a cable segment to a mating segment. The housing has an intermediate segment that extends between the cable and mating segments. The intermediate segment includes a flange. The housing is mounted to the frame. An electrical contact is held by the housing and is configured to establish an electrical connection between the junction box and an electrical cable of a power distribution system. A biasing mechanism extends over the intermediate segment of the housing. The biasing mechanism is engaged between the frame and the flange of the housing such that the biasing mechanism exerts a biasing force on the flange and the frame. The electrical connector is movable relative to the frame and along the central longitudinal axis with and against the biasing force of the biasing mechanism.

DETAILED DESCRIPTION OF THE INVENTION

Figure 1:
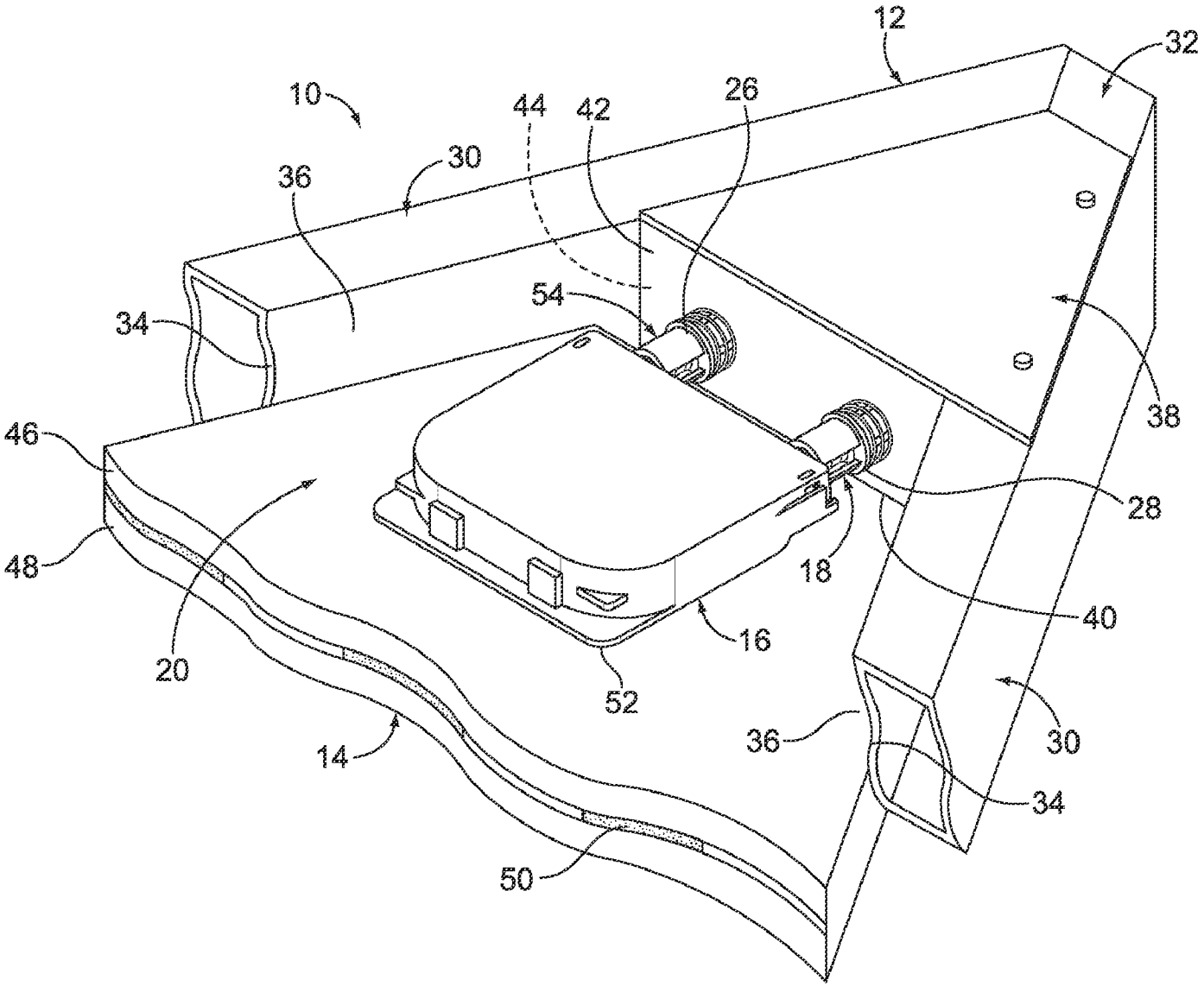
FIG. 1 is a perspective view of an exemplary embodiment of a photovoltaic (PV) module assembly.

FIG. 1 is a perspective view of an exemplary embodiment of a photovoltaic (PV) module assembly 10. The assembly 10 includes a frame 12, a PV module 14, a junction box 16, and one or more electrical connectors 18. Only portions of the frame 12 and the PV module 14 are shown in FIG. 1. The PV module 14 is held within a receptacle 20 of the frame 12. The junction box 16 is mounted on and electrically connected to the PV module 14. The electrical connectors 18 mate with the junction box 16 to establish an electrical connection between the junction box 16 and electrical cables 22 (FIG. 5) of a power distribution system (not shown). The electrical connectors 18 are mounted to the frame 12. As will be described in more detail below, the electrical connectors 18 include biasing mechanisms 26 that are engaged between the frame 12 and housings 28 of the electrical connectors 18. When mounted to the frame 12, the electrical connectors 18 are movable relative to the frame 12 with and against the biasing force of the biasing mechanisms 26.

In the exemplary embodiment, the frame 12 includes arms 30 joined together at a corner 32 of the frame 12. The arms 30 include interior walls 34 having interior sides 36. A cross member 38 extends between the arms 30 proximate the corner 32. The cross member 38 includes an interior wall 40 having a module side 42 and an opposite cable side 44. The arms 30 of the frame 12 are spaced apart from each other to define at least a portion of the receptacle 20 of the frame 12 therebetween. The module side 42 of the interior wall 40 and the interior sides 36 of the interior walls 34 define boundaries of the receptacle 20. The receptacle 20 may include any other shape than the shape that is shown herein. Optionally, the shape of the receptacle 20 is complementary to a shape of the PV module 14.

As can be seen in FIG. 1, the PV module 14 is held within the receptacle 20 of the frame 12. Optionally, when the PV module 14 is held within the receptacle 20 of the frame 12, the PV module 14 engages the module side 42 of the interior wall 40 and/or engages one or more of the interior sides 36 of the interior walls 34. The PV module 14 includes a dielectric substrate 46, a transparent panel 48, and a plurality of PV cells 50 held between the dielectric substrate 46 and the transparent panel 48. When irradiated by a light source (such as, but not limited to, sunlight and/or the like), the PV cells 50 convert the energy of photons into electrical power. The PV cells 50 of the PV module 14 are electrically interconnected with each other, in series and/or parallel, by an electrically conductive foil (not shown).

The junction box 16 is mounted on the PV module 14 for electrically connecting the PV module 14 to the power distribution system (not shown). The power distribution system distributes electrical power generated by the PV module 14 to an electrical load (not shown), an electrical storage device (not shown), and/or the like. In addition or alternatively, the power distribution system may electrically connect the PV module 14 to other PV modules (not shown). For example, a plurality of PV modules may be electrically interconnected, in series and/or parallel, to create a PV panel (not shown). Moreover, a plurality of PV panels may be electrically interconnected to create a PV array (not shown).

The junction box 16 includes a housing 52 that holds electrical contacts (not shown). The electrical contacts of the junction box 16 are electrically connected to the electrically conductive foil of the PV module 14. The housing 52 of the junction box 16 includes one or more ports 54 for mating with the electrical connectors 18. Mating interfaces (not shown) of the electrical contacts extend within or proximate the ports 54 for mating with electrical contacts 62 (FIGS. 2-4) of the electrical connectors 18. In the exemplary embodiment, the ports 54 of the junction box 16 define receptacles that receive mating segments 72 (FIGS. 2-5) of housings 60 (FIGS. 2-5) of the electrical connectors 18 therein. Alternatively, one or more of the ports 54 defines a plug (not shown) that is received within the mating segment 72 of the corresponding electrical connector housing 60.

Although two electrical connectors 18 are shown, the PV module assembly 10 may include any number of the electrical connectors 18 for electrically connecting the junction box 16 to any number of electrical cables 22. In the exemplary embodiment, two electrical connectors 18 are provided for electrically connecting the junction box 16 to two electrical cables 22 that represent positive and ground. In another embodiment, three electrical connectors 18 are provided for electrically connecting the junction box 16 to three electrical cables 22 that represent positive, neutral, and ground. Although the electrical connectors 18 are mounted on the interior wall 40 of the cross member 38, each of the electrical connectors 18 may alternatively be mounted to any other location on, and any component of, the frame 12, including any locations and components not shown and/or described herein.

Figure 2:
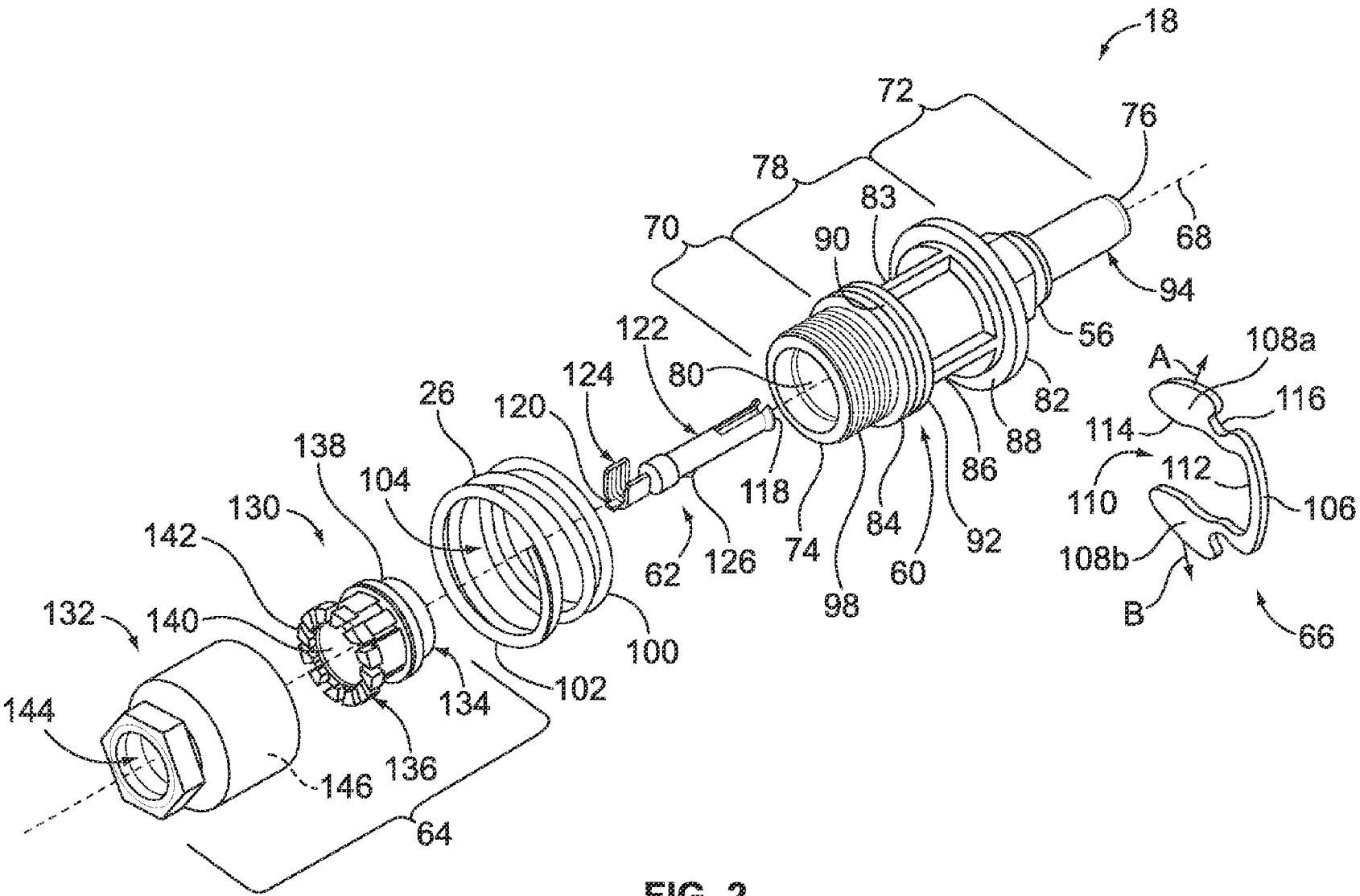
FIG. 2 is an exploded perspective view of an exemplary embodiment of an electrical connector of the PV module assembly shown in FIG. 1.

FIG. 2 is an exploded perspective view of an exemplary embodiment of one of the electrical connectors 18. The electrical connector 18 includes the housing 60, the electrical contact 62, the biasing mechanism 26, an optional cable ferrule assembly 64, and an optional retainment clip 66. The housing 60 extends along a central longitudinal axis 68 from a cable segment 70 to a mating segment 72. The cable segment 70 includes an end 74 of the housing 60, while the mating segment 72 includes an opposite end 76 of the housing 60. An intermediate segment 78 extends between the cable segment 70 and the mating segment 72. A central passageway 80 extends through the housing 60 along the length thereof. The central passageway 80 is configured to receive the electrical contact 62 and an end 96 (FIG. 5) of the corresponding electrical cable 22 (FIG. 5) therein.

The intermediate segment 78 includes a flange 82 and an optional flange 84. A barrel 86 of the intermediate segment 78 extends between the flanges 82 and 84. The barrel 86 extends a length from the flange 82 to the flange 84, which spaces the flanges 82 and 84 apart along the length of the housing 60. The barrel 86 includes optional support ribs 83 extending along the length of the barrel 86. The flange 82 extends radially outward relative to the barrel 86 such that the flange 82 has a greater cross-sectional size than the barrel 86. In the exemplary embodiment, the barrel 86 and the flange 82 are cylindrically shaped such that the flange 82 has a greater diameter than the barrel 86. The flange 82 includes an engagement surface 88 that is configured to engage the biasing mechanism 26 when the housing 60 is mounted to the frame 12 (FIGS. 1 and 3-5). The flange 84 includes an optional retainment groove 90. The retainment groove 90 extends radially inward into an outermost surface 92 of the flange 84. The retainment groove 90 is configured to receive the retainment clip 66 therein. Although shown as having a rectangular cross-sectional shape, the retainment groove 90 may additionally or alternatively include any other shape for receiving a retainment clip 66 that includes any shape.

The mating segment 72 of the housing 60 includes a mating interface 94 that is configured to mate with a corresponding one of the ports 54 (FIG. 1) of the junction box 16 (FIG. 1). The mating segment 72 includes an optional o-ring 56 for sealing engagement with the corresponding port 54. In the exemplary embodiment, the mating interface 94 is defined by a plug that is configured to be received within the receptacle of the corresponding port 54. Alternatively, the mating interface 94 is defined by a receptacle (not shown) that receives a plug (not shown) of the corresponding port 54 of the junction box 16.

The cable segment 70 of the housing 60 is configured to mechanically connect to the corresponding electrical cable 22. More particularly, the central passageway 80 of the housing 60 extends through the cable segment 70 for receiving the end 96 of the corresponding electrical cable 22 through the cable segment 70. The cable segment 70 includes a threaded nipple 98 for threadable connection to the cable ferrule assembly 64. As will be described below, the threaded nipple 98 and the cable ferrule assembly 64 cooperate to hold the end 96 of the electrical cable 22 within the central passageway 80 of the housing 60.

In the exemplary embodiment, the housing 60 has the overall general shape of a cylinder, with segments and flanges of differing diameters. But, the housing 60 may additionally or alternatively include other shapes. Moreover, each segment 70, 72, and 78, and each flange 82 and 84, may additionally or alternatively include other shapes besides a cylindrical shape, whether or not such other shapes are the same, similar, or different from the shapes of the other segments (e.g., the segments 70, 72, and/or 78) and/or the other flanges (e.g., the flanges 82 and/or 84) of the housing 60. For example, in an alternative embodiment, the flange 82 has a rectangular shape, while the barrel 86 retains the exemplary cylindrical shape shown herein.

The biasing mechanism 26 extends from a flange end 100 to an opposite frame end 102. The flange end 100 is configured to engage the engagement surface 88 of the housing flange 82. The frame end 102 is configured to engage the interior wall 40 (FIGS. 1 and 3-5) of the frame 12. In the exemplary embodiment, the biasing mechanism 26 is a spring. More particularly, the biasing mechanism 26 is a helical coil spring having a central opening 104 extending therethrough along the length thereof. The biasing mechanism 26 is configured to receive the housing 60 within the central opening 104 such that the biasing mechanism 26 extends around the barrel 86 of the housing 60. As will be described in more detail below, when the housing 60 is received within the central opening 104 and mounted to the frame 12, the biasing mechanism 26 is engaged between the housing flange 82 and the interior wall 40 of the frame 12.

The biasing mechanism 26 is not limited to a helical coil spring. Rather, the biasing mechanism 26 may be any other type of spring, such as, but not limited to, a leaf spring, a v-spring, a belleville spring, a gas spring, a rubber band, a constant force spring, a wave spring, and/or the like. Moreover, in addition or alternative to being a spring, the biasing mechanism 26 may include a damper (not shown). For example, in one alternative embodiment, the helical coil spring is replaced by a damper that is configured to be engaged between the flange 82 of the housing 60 and the interior wall 40 of the frame 12. In another alternative embodiment, a damper extends around the barrel 86 of the housing 60 within the central opening 104 of the biasing mechanism 26 such that the biasing mechanism 26 is what is commonly referred to as a "coilover" biasing mechanism.

The retainment clip 66 includes a base 106 and arms 108*a* and 108*b* that extend from the base 106. The arms 108*a* and 108*b* are spaced apart to define an opening 110 therebetween. An inner edge 112 of the base 106 and inner edges 114 of the arms 108*a* and 108*b* define boundaries of the opening 110, which is open opposite the base 106. The arms 108*a* and 108*b* are resiliently deflectable in the respective directions A and B. In other words, the arms 108*a* and 108*b* can be spread apart to enlarge the opening 110. The inner edge 112 of the base 106 and the inner edges 114 of the arms 108*a* and 108*b* are configured to be received within the retainment groove 90 of the housing 60. The resilience of the arms 108*a* and 108*b* enables the retainment clip 66 to be received within the retainment groove 90 in a snap-fit relationship. The retainment clip 66 includes optional notches 116 for moving the arms 108*a* and 108*b* in the respective directions A and B, for example, using a tool, a person's fingers, and/or the like.

The electrical contact 62 extends a length from an end 118 to an opposite end 120. The electrical contact 62 includes a mating interface 122 and a cable interface 124. The mating interface 122 includes the end 118. The electrical contact 62 is configured to be held within the central passageway 80 of the housing 60 such that the mating interface 122 of the electrical contact 62 extends along the mating interface 94 of the housing 60. Optional barbs 126 are provided on the electrical contact 62 for engaging the housing 60 to hold the electrical contact 62 within the central passageway 80. The mating interface 122 is configured to mate with a corresponding one of the electrical contacts (not shown) of the junction box 16. The exemplary embodiment of the mating interface 122 of the electrical contact 62 includes a receptacle that is configured to receive a plug (not shown) of the corresponding electrical contact of the junction box 16. But, the mating interface 122 may include any other configuration for mating with the corresponding electrical contact of the junction box 16. For example, in an alternative embodiment, the mating interface 122 includes a plug that is configured to be received within a receptacle (not shown) of the corresponding electrical contact of the junction box 16.

The cable interface 124 includes the end 120 of the electrical contact 62. The cable interface 124 is configured to mechanically and electrically connect to an electrical conductor (not shown) of the corresponding electrical cable 22. In the exemplary embodiment, the cable interface 124 of the electrical contact 62 includes crimp arms that are configured to be crimped over the electrical conductor of the corresponding electrical cable 22. However, any other configuration of the cable interface 124 is possible that enables the cable interface 124 to mechanically and electrically connect to the corresponding electrical conductor of the corresponding electrical cable 22.

The cable ferrule assembly 64 includes a pinch ring 130 and a screw joint 132. The pinch ring 130 includes a support member 134 and a spring member 136 mounted on the support member 134. The support member 134 includes a base 138 and a support shaft 140 extending from the base 138. The spring member 136 extends around the support shaft 140 and includes a plurality of spring fingers 142 that are resiliently deflectable radially inwardly relative to the central longitudinal axis 68. The screw joint 132 includes a central passage 144 for receiving the end 96 of the corresponding electrical cable 22 therethrough. An interior surface 146 of the screw joint 132 that defines the central passage 144 is threaded for threadably connecting the screw joint 132 to the threaded nipple 98 of the housing 60. The spring fingers 142 of the spring member 136 are configured to engage the end 96 of the corresponding electrical cable 22 to hold the end 96 within the central passageway 80 of the housing 60. The screw joint 32 is threaded onto the threaded nipple 98 of the housing 60 over the pinch ring 130 to hold the pinch ring 130, and thus the end 96 of the electrical cable 22, within the housing 60.

Figure 3:
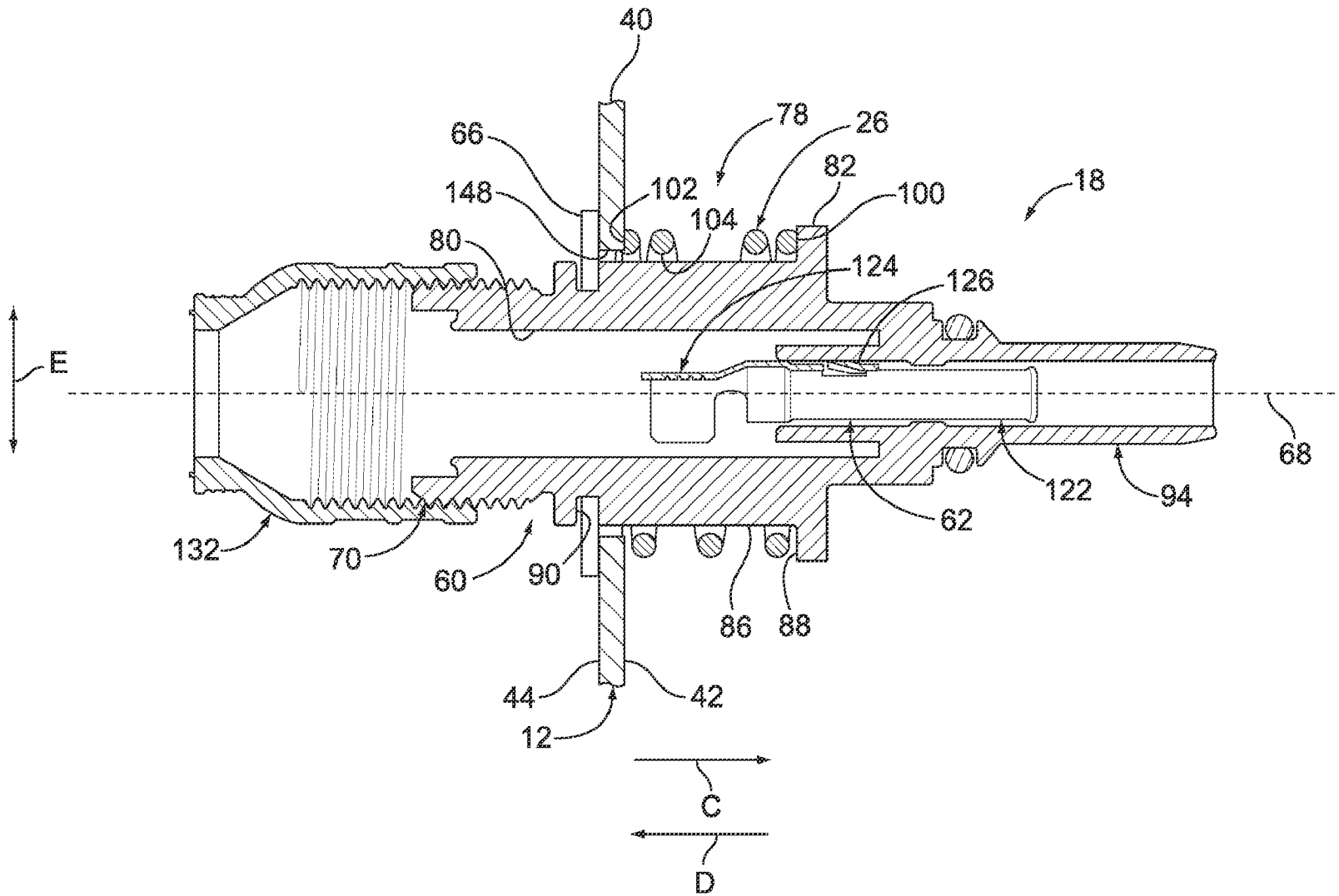
FIG. 3 is a cross-sectional view of the electrical connector shown in FIG. 2 illustrating the electrical connector mounted to an exemplary embodiment of a frame of the PV module assembly shown in FIG. 1.
Figure 4:
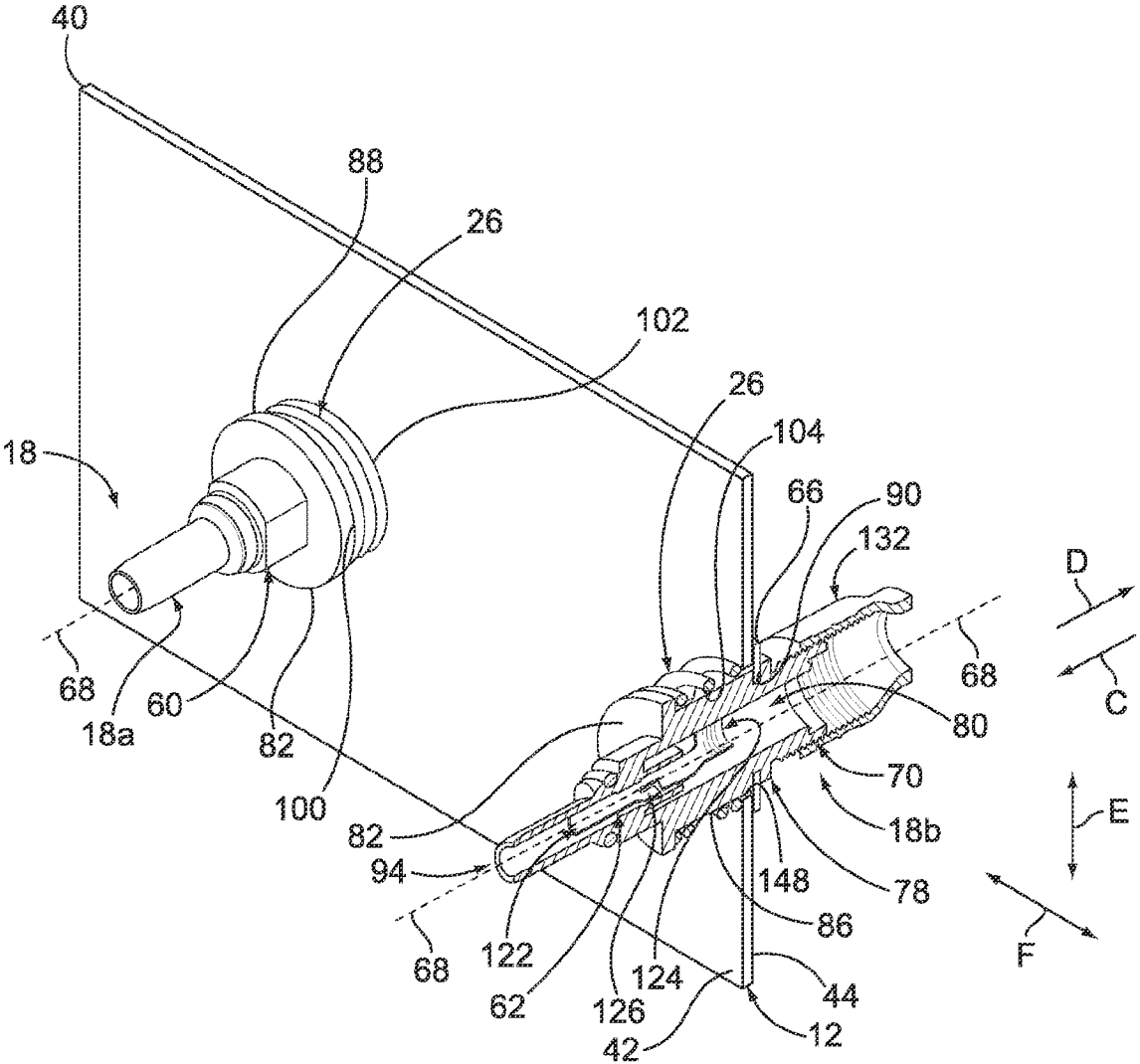
FIG. 4 is a partially broken away perspective view of a plurality of the electrical connectors shown in FIG. 2 mounted to the frame.

FIG. 3 is a cross-sectional view of the electrical connector 18 illustrating the electrical connector 18 mounted to the frame 12. FIG. 4 is a partially broken away perspective view of a plurality of the electrical connectors 18 mounted to the frame 12. Referring now to FIGS. 3 and 4, the electrical connector 18 is mounted on the interior wall 40 of the frame 12. The interior wall 40 includes the module side 42, the cable side 44, and a connector opening 148 that extends through the interior wall 40. The housing 60 of the electrical connector 18 is mounted to the interior wall 40. The housing 60 extends through the connector opening 148. The interior wall 40 extends around the intermediate segment 78 of the housing 60 at the connector opening 148. The mating segment 72 and the flange 82 of the housing 60 extend along the module side 42 of the interior wall 40. The cable segment 70 of the housing 60 extends along the cable side 44 of the interior wall 40. FIGS. 3 and 4 each illustrates the screw joint 132 of the cable ferrule assembly 64 (FIGS. 2 and 5) threadably engaged with the cable segment 70 of the housing 60. A combination of the frame 12 and the electrical connector 18 may be referred to herein as an "electrical connector assembly".

The electrical contact 62 is received within the central passageway 80 of the housing 60. The mating interface 122 of the electrical contact 62 extends within the central passageway 80 along the mating interface 94 of the housing 60. The cable interface 124 of the electrical contact 62 extends within the central passageway 80 along the intermediate segment 78 of the housing 60 for mechanical and electrical connection to the electrical conductor (not shown) of the corresponding electrical cable 22. The barbs 126 of the electrical contact 62 are engaged with the housing 60 within the central passageway 80 to hold the electrical contact 62 in position within the central passageway 80.

The biasing mechanism 26 extends over the intermediate segment 78 of the housing 60. The housing 60 extends through the central opening 104 of the biasing mechanism 26 such that the biasing mechanism 26 extends around the barrel 86 of the intermediate segment 78. The biasing mechanism 26 extends, and is engaged, between the flange 82 of the housing 60 and the interior wall 40 of the frame 12. Specifically, the flange end 100 of the biasing mechanism 26 is engaged with the engagement surface 88 of the flange 82, and the frame end 102 of the biasing mechanism 26 is engaged with the module side 42 of the interior wall 40. The biasing mechanism 26 exerts a biasing force on the flange 82 and the interior wall 40 of the frame 12. In the exemplary embodiment, the biasing mechanism 26 is a compression spring. As the biasing mechanism 26 is compressed along the central longitudinal axis 68, the biasing mechanism 26 exerts the biasing force on the flange 82 in a direction C that biases the flange 82 away from the module side 42 of the interior wall 40 of the frame 12. The biasing force exerted on the module side 42 of the interior wall 40 as the biasing mechanism 26 is compressed extends in an opposite direction D. Alternatively, the biasing mechanism 26 is a tension spring that exerts the biasing force on the flange 82 in the direction D and on the interior wall 40 in the direction C as the biasing mechanism 26 is stretched along the central longitudinal axis 68.

The electrical connector 18 is movable relative to the frame 12 along the central longitudinal axis 68 with and against the biasing force of the biasing mechanism 26. Specifically, the electrical connector 18 is movable along the central longitudinal axis 68 in the directions C and D. Compression of the biasing mechanism 26 enables the housing 60 of the electrical connector 18 to move in the direction D. When the housing 60 of the electrical connector 18 moves in the direction D, the biasing mechanism 26 is compressed along the central longitudinal axis 68. When at least partially compressed, the biasing mechanism 26 exerts the biasing force on the flange 82 in the direction C. Accordingly, the housing 60 is movable in the direction D against the biasing force of the biasing mechanism 26. FIG. 3 illustrates the electrical connector 18 before the housing 60 has been moved in the direction D such that the biasing mechanism 26 is not compressed. One of the electrical connectors 18*a* illustrated in FIG. 4 is shown after the housing 60 has moved in the direction D, wherein the biasing mechanism 26 is compressed. The other electrical connector 18*b* illustrated in FIG. 4 is shown before the housing 60 has been moved in the direction D such that the biasing mechanism 26 is not compressed.

The housing 60 is movable in the direction D relative to the frame 12 and along the central longitudinal axis 68 by applying a moving force to the housing 60 in the direction D. When the moving force is released from the housing 60 after the flange 82 of the housing 60 has moved closer to the interior wall 40, the biasing force exerted on the flange 82 by the at least partial compression of the biasing mechanism 26 moves the housing 60 back in the direction C. Accordingly, the housing 60 is movable in the direction C with the biasing force of the biasing mechanism 26. The moving force may be applied to the housing 60 of the electrical connector 18 using any suitable method, means, and/or the like, such as, but not limited to, directly applying the moving force to the housing 60 using a tool (not shown), a person's hand and/or other body part, the PV module 14, the junction box 16, and/or the like. The moving force may also be indirectly applied to the housing 60, for example by pulling on the electrical cable 22, the screw joint 132, and/or the like.

The retainment clip 66 is received within the retainment groove 90 of the housing 60 such that the retainment clip 66 extends over the intermediate segment 78 of the housing 60 along the cable side 44 of the interior wall 40 of the frame 12. The retainment clip 66 provides a stop for movement of the housing 60 relative to the interior wall 40 of the frame 12. Specifically, as best seen in FIG. 3, the retainment clip 66 has a larger size (e.g., a larger diameter) than the connector opening 148 of the interior wall 40 of the frame 12. The retainment clip 66 therefore cannot pass through the connector opening 148 when the housing 60 is mounted to the interior wall 40 and the retainment clip 66 is received within the retainment groove 90. As the housing 60 of the electrical connector 18 moves relative to the frame in the direction C, the retainment clip 66 engages the cable side 44 of the interior wall 40 of the frame 12 to prevent further movement of the housing 60 in the direction C.

Optionally, the housing 60 of the electrical connector 18 is movable relative to the interior wall 40 of the frame 12 in one or more directions that are non-parallel relative to the central longitudinal axis 68. For example, in the exemplary embodiment, the barrel 86 of the intermediate segment 78 is sized smaller (e.g., in diameter) than the connector opening 148. Accordingly, the housing 60 of the electrical connector 18 can move within the connector opening 148 in directions that are perpendicular (e.g., the direction E shown in FIGS. 3 and 4 and the direction F shown in FIG. 4) to the central longitudinal axis 68. As should be apparent from FIGS. 3 and 4, the biasing mechanism 26 and the retainment clip 66 cooperate to hold the housing 60 to the interior wall 40 of the frame 12 during movement of the housing 60 in directions that are perpendicular to the central longitudinal axis 68.

The relative size of the barrel 86 of the housing 60 and the connector opening 148 of the frame 12 also enables the housing 60 to be tilted relative to the interior wall 40 of the frame 12. For example, the housing 60 can be pivoted about the connector opening 148 of the interior wall 40 such that the central longitudinal axis 68 of the housing 60 extends obliquely to the interior wall 40, instead of the perpendicular arrangement shown in FIGS. 3 and 4. Non-linear, or un-even, compression of the biasing mechanism 26 accommodates tilting of the housing 60.

Figure 5:
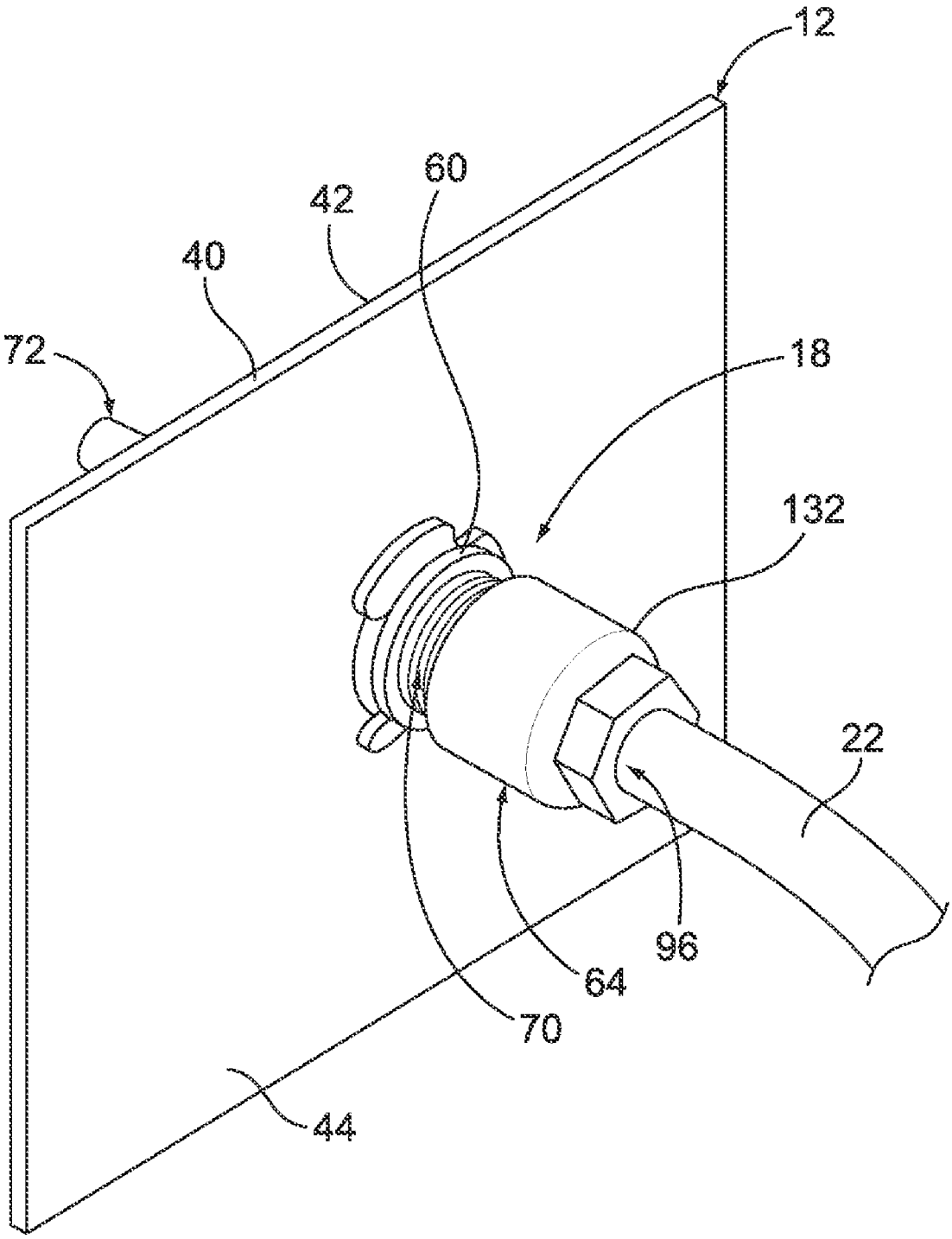
FIG. 5 is a perspective view of the electrical connector shown in FIG. 2 illustrating the electrical connector mounted on the frame and terminating an exemplary electrical cable.

FIG. 5 is a perspective view of the electrical connector 18 illustrating the electrical connector 18 mounted on the frame 12 and terminating the corresponding electrical cable 22. The cable segment 70 of the housing 60 extends along the cable side 44 of the interior wall 40 of the frame 12. The end 96 of the electrical cable 22 is received through the screw joint 132 of the cable ferrule assembly 64 and into the central passageway 80 (FIGS. 2-4) of the housing 60. Although not shown, the electrical conductor of the electrical cable 22 is engaged with the cable interface 124 (FIGS. 2-4) of the electrical contact 62 (FIGS. 2-4) of the electrical connector 18 to electrically connect the electrical conductor of the electrical cable 22 to the electrical contact 62.

The mating segment 72 of the housing 60 of the electrical connector 18 extends along the module side 42 of the interior wall 40 for mating with the corresponding port 54 (FIG. 1) of the junction box 16 (FIG. 1). When the mating segment 72 is mated with the corresponding port 54, the electrical contact 62 establishes an electrical connection between the electrical conductor of the electrical cable 22 and the corresponding electrical contact (not shown) of the junction box 16. The electrical connector 18 thereby establishes an electrical connection between the PV module 14 and the electrical power distribution system.

The embodiments described and/or illustrated herein may provide an electrical connector that is more easily matable with the junction box of a PV module than at least some known electrical connectors.

Exemplary embodiments are described and/or illustrated herein in detail. The embodiments are not limited to the specific embodiments described herein, but rather, components and/or steps of each embodiment may be utilized independently and separately from other components and/or steps described herein. Each component, and/or each step of one embodiment, can also be used in combination with other components and/or steps of other embodiments. When introducing elements/components/etc. described and/or illustrated herein, the articles "a", "an", "the", "said", and "at least one" are intended to mean that there are one or more of the element(s)/component(s)/etc. The terms "comprising", "including" and "having" are intended to be inclusive and mean that there may be additional element(s)/component(s)/etc. other than the listed element(s)/component(s)/etc. Moreover, the terms "first," "second," and "third," etc. in the claims are used merely as labels, and are not intended to impose numerical requirements on their objects. Dimensions, types of materials, orientations of the various components, and the number and positions of the various components described and/or illustrated herein are intended to define parameters of certain embodiments, and are by no means limiting and are merely exemplary embodiments. Many other embodiments and modifications within the spirit and scope of the claims will be apparent to those of skill in the art upon reviewing the description and illustrations. The scope of the subject matter described and/or illustrated herein should therefore be determined with reference to the appended claims, along with the full scope of equivalents to which such claims are entitled. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

While the subject matter described and/or illustrated herein has been described in terms of various specific embodiments, those skilled in the art will recognize that the subject matter described and/or illustrated herein can be practiced with modification within the spirit and scope of the claims.

What is claimed is:

1. A photovoltaic (PV) connector for electrically connecting to an electrical cable of a power distribution system, said electrical connector comprising:

a housing extending along a central longitudinal axis from a cable segment to a mating segment, the housing having an intermediate segment that extends between the cable and mating segments, the intermediate segment comprising a flange, the housing being configured to be mounted to a frame for the PV connector;

an electrical contact held by the housing and being configured to establish an electrical connection between the junction box and the electrical cable; and a biasing mechanism extending over the intermediate segment of the housing, the biasing mechanism extending from a flange end to a frame end, the flange end being engaged with the flange of the housing, the frame end being configured to engage the frame such that, when the housing is mounted on the frame, the biasing mechanism extends between and exerts a biasing force on the flange and the frame, the housing being movable relative to the frame and along the central longitudinal axis with and against the biasing force of the biasing mechanism.

2. The PV connector according to claim 1, wherein the biasing mechanism comprises a spring.

3. The PV according to claim 1, wherein the intermediate segment of the housing comprises a barrel, the biasing mechanism comprising a helical coil spring having a central opening extending therethrough, the housing extending through the central opening of the helical coil spring such that the helical coil spring extends around the barrel.

4. The PV connector according to claim 1, wherein when the housing is mounted to the frame, the biasing mechanism is configured to exert the biasing force on the flange of the housing in a direction along the central longitudinal axis that biases the flange away from the frame.

5. The PV connector according to claim 1, wherein the housing is configured to move relative to the frame in at least one direction that is non-parallel to the central longitudinal axis when the housing is mounted to the frame.

6. The PV 1 connector according to claim 1, wherein the intermediate segment of the housing comprises a retainment groove, the electrical connector further comprising a retainment clip configured to be received within the retainment groove to provide a stop for movement of the housing relative to the frame.

7. The PV connector according to claim 1, wherein the intermediate segment of the housing comprises a retainment groove, the electrical connector further comprising a retainment clip configured to be received within the retainment groove in a snap-fit relationship.

8. The PV connector according to claim 1, wherein the cable segment comprises a threaded nipple for threadable connection to a cable ferrule assembly 9. photovoltaic (PV) connector assembly for electrically connecting to an electrical cable of a power distribution system, said electrical connector assembly comprising:

a frame having a receptacle configured to receive the PV connector therein; and an electrical connector comprising:

a housing extending a length along a central longitudinal axis from a cable segment to a mating segment, the housing having an intermediate segment that extends between the cable and mating segments, the intermediate segment comprising a flange, the housing being mounted to the frame;

an electrical contact held by the housing and being configured to establish an electrical connection between the junction box and the electrical cable; and a biasing mechanism extending over the intermediate segment of the housing, the biasing mechanism being engaged between the frame and the flange of the housing such that the biasing mechanism exerts a biasing force on the flange and the frame, the electrical connector being movable relative to the frame and along the central longitudinal axis with and against the biasing force of the biasing mechanism.

10. The PV connector assembly according to claim 9, wherein the electrical connector is moveable relative to the frame in at least one direction that is non-parallel to the central longitudinal axis.

11. The PV connector assembly according to claim 9, wherein the frame comprises a connector opening, the housing extending through the connector opening such that the frame extends around the intermediate segment of the housing at the connector opening, the intermediate segment being sized smaller than the connector opening such that the electrical connector is moveable within the connector opening in at least one direction that is non-parallel to the central longitudinal axis.

12. The PV connector assembly according to claim 9, wherein the frame comprises a module side that defines a boundary of the receptacle and an opposite cable side, the flange of the housing extending along the module side of the frame such that the biasing mechanism is engaged between the flange and the module side of the frame, the biasing mechanism being configured to exert the biasing force on the flange in a direction along the central longitudinal axis that biases the flange away from the module side of the frame.

13. The PV connector assembly according to claim 9, wherein the frame comprises a module side that defines a boundary of the receptacle and an opposite cable side, the electrical connector further comprising a retainment clip extending over the intermediate segment of the housing along the cable side of the frame, the retainment clip being configured to engage the cable side of the frame to provide a stop for movement of the electrical connector relative to the frame along the central longitudinal axis.

14. The PV connector assembly according to claim 9, wherein the intermediate segment of the housing comprises a retainment groove, the electrical connector further comprising a retainment clip received within the retainment groove.

15. The PV connector according to claim 9, wherein the frame comprises a connector opening, the housing extending through the connector opening, the electrical connector further comprising a retainment clip extending over the housing, at least a portion of the retainment clip being sized larger than the connector opening such that the retainment clip cannot pass through the connector opening when the housing is mounted to the frame and the retainment clip is received on the housing.

16. The PV connector assembly according to claim 9, wherein the biasing mechanism comprises a spring.

17. The PV connector assembly according to claim 9, wherein the intermediate segment of the housing comprises a barrel, the biasing mechanism comprising a helical coil spring having a central opening extending therethrough, the housing extending through the central opening of the helical coil spring such that the helical coil spring extends around the barrel of the intermediate segment of the housing.

18. The PV connector assembly according to claim 9, wherein the frame comprises a module side that defines a boundary of the receptacle and an opposite cable side, the mating segment of the housing extending along the module side of the frame, the cable segment of the housing extending along the cable side, the flange of the housing extending along the module side of the frame such that the biasing mechanism is engaged between the flange and the module side of the frame.

19. The PV connector assembly according to claim 9, wherein the frame comprises a connector opening, the housing of the electrical connector extending through the connector opening of the frame.

20. A photovoltaic (PV) module assembly comprising: a frame having a receptacle; a PV module held within the receptacle of the frame;

a junction box mounted on and electrically connected to the PV module; and an electrical connector comprising:

a housing extending a length along a central longitudinal axis from a cable segment to a mating segment, the housing having an intermediate segment that extends between the cable and mating segments, the intermediate segment comprising a flange, the housing being mounted to the frame;

an electrical contact held by the housing and being configured to establish an electrical connection between the junction box and an electrical cable of a power distribution system; and a biasing mechanism extending over the intermediate segment of the housing, the biasing mechanism being engaged between the frame and the flange of the housing such that the biasing mechanism exerts a biasing force on the flange and the frame, the electrical connector being movable relative to the frame and along the central longitudinal axis with and against the biasing force of the biasing mechanism 3. The following is an examiner's statement of reasons for allowance: None of prior art teaches or suggests a photovoltaic (PV) connector for electrically connecting to an electrical cable of a power distribution system, said electrical connector comprising the intermediate segment comprising a flange, the housing being configured to be mounted to a frame for the PV connector; an electrical contact establishes an electrical connection between the junction box and the electrical cable; a biasing mechanism extending over the intermediate segment of the housing from a flange end of the housing to a frame end of the frame, the biasing mechanism extends between and exerts a biasing force on the flange and the frame.

* * * * *